United States Patent [19]

Insch

[11] 4,164,332

[45] Aug. 14, 1979

[54] LINE WIND-UP MECHANISM FOR MARKER BUOYS

[76] Inventor: Paul H. Insch, P.O. Box 2818, Hickory, N.C. 28601

[21] Appl. No.: 923,541

[22] Filed: Jul. 11, 1978

[51] Int. Cl.[2] ..... B65H 75/00

[52] U.S. Cl. ..... 242/54 R; 242/16

[58] Field of Search ..... 242/54 R, 67.1 R, 96, 242/7.05 B, 7.15, 7.06; 43/42.11

[56] References Cited

U.S. PATENT DOCUMENTS

| | | | |
|---|---|---|---|
| 126,199 | 6/1872 | Gibbs | 242/96 |
| 274,490 | 3/1883 | Gunn | 242/96 |
| 955,366 | 4/1910 | Simons | 242/96 |
| 1,555,167 | 9/1925 | Switzer | 242/96 |
| 2,514,970 | 7/1950 | Prickett | 242/7.15 |
| 3,185,407 | 5/1965 | Lichtenstein | 242/96 |
| 3,892,366 | 7/1975 | Ott | 242/7.05 B |

*Primary Examiner*—Edward J. McCarthy

*Attorney, Agent, or Firm*—Buell, Blenko & Ziesenheim

[57] ABSTRACT

A device for quickly and easily retrieving the line of a fisherman's marker buoy by attaching the buoy therein and rotating it manually through gear multiplication at a high speed. The device comprises a rigid frame or housing for carrying a pair of rotary cups or spindles in axially aligned spaced relation. One of the cups is biased toward the other to yieldingly retain a marker buoy coaxially therebetween for rotation with the cups. The said other rotary cup is fixedly mounted on a pedestal for rotation, through intermeshed gears within the pedestal, a driving gear having a handle in radially outwardly displaced relation to a driven gear connected to the said other cup.

8 Claims, 4 Drawing Figures

LINE WIND-UP MECHANISM FOR MARKER BUOYS

This invention relates to a device for easily and quickly retrieving or rewinding the line of a fisherman's marker buoy back onto the reel of the buoy as well as to retrieve the line of a fisherman's so-called "plug knocker", a cylindrical weight for freeing a hung-up lure.

Many desirable fresh water game fish, notably large mouth, small mouth and striped bass prefer as their underwater habitat, submerged objects such as trees or large refuse contours like ledges or reefs or structural irregularities such as creek channels, drop offs or old road beds. Locating and marking of these underwater structures becomes a primary objective of the sport for recreational fisherman. Locating is often accomplished by means of electronic sonar equipment or by dragging weighted lines along the lake floor until an object is located.

Having located a likely fishing area, the angler needs to mark its location so that he may return to it after moving on in search of other potentially desirable fishing sites. Speed is also of the essence in order to maximize the number of presentations of lures to the fish and, consequently, the number of strikes and catches of the fish themselves. By marking likely locations, the fisherman allows himself to both remember where they were and return to them quickly.

In order to easily and expeditiously mark these locations, fisherman often employ small marker buoys having a reel with a length of line wound thereon usually between sixty and one hundred feet in length and a sinker weight of some three to five ounces attached. These buoys are tossed overboard by the fisherman at the site of the underwater body and the weight plays out the line until it comes to rest on the lake floor, the buoy floating above.

The buoys may also be used for so-called "jug fishing" in which a baited hook would replace the sinker with enough weight added to ride the hook to the bottom of the lake or river and lure fish who lie there, such as catfish.

When a lure becomes "hung-up" or snagged on brush or vegetation, the fisherman uses a so-called "plug-knocker", which is a cylindrical weight with a shovel-shaped point to free the lure.

The plug-knocker is at the end of a line connected to a bar referred to as the "plug-knocker bar". When the plug-knocker is run down a line to a hung-up lure, it will frequently break the lure or "plug" free, thus enabling it to be retrieved and used again.

At the end of his fishing day, the fisherman must retrieve his buoy markers. Ordinarily the buoys would have to be taken from the water and rewound by hand. This process is not only time consuming and at the end of a long day, fatiguing as well, but also in bad weather conditions such as the cold, can become very uncomfortable, wetting the gloves and prolonging exposure.

it is an object of my invention, therefore, to provide a device for quickly and easily retrieving or rewinding a line having thereon a lure or a plug-knocker back onto the reel of the marker buoy or upon the plug-knocker bar.

It is a further object of my invention to provide a device for the purpose heretofore mentioned which is of simple low-cost construction, and which may be readily carried by a fisherman to locations where it can be advantageously used to retrieve the lines of marker buoys or of plug-knockers.

My invention specifically comprises a rigid frame or housing in which a pair of cups of spindles are rotarily mounted in coaxially aligned spaced relation. One of the cups is biased by a caged or compressed spring toward the other of the cups which is driven at a relatively high speed through a series of speed-amplifying gears, the outer one of which is rotated manually. The marker buoy or plug-knocker bar, or both, may be placed between the cups, one of which yields in an axial direction to enable the buoy or plug-knocker bar to be placed therebetween and yieldingly retained in coaxial relation to the cups.

The above objects and other objects hereinafter made more apparent are attained by a preferred embodiment of my invention, later described in detail and shown in the accompanying drawings, wherein.

Figure 1:
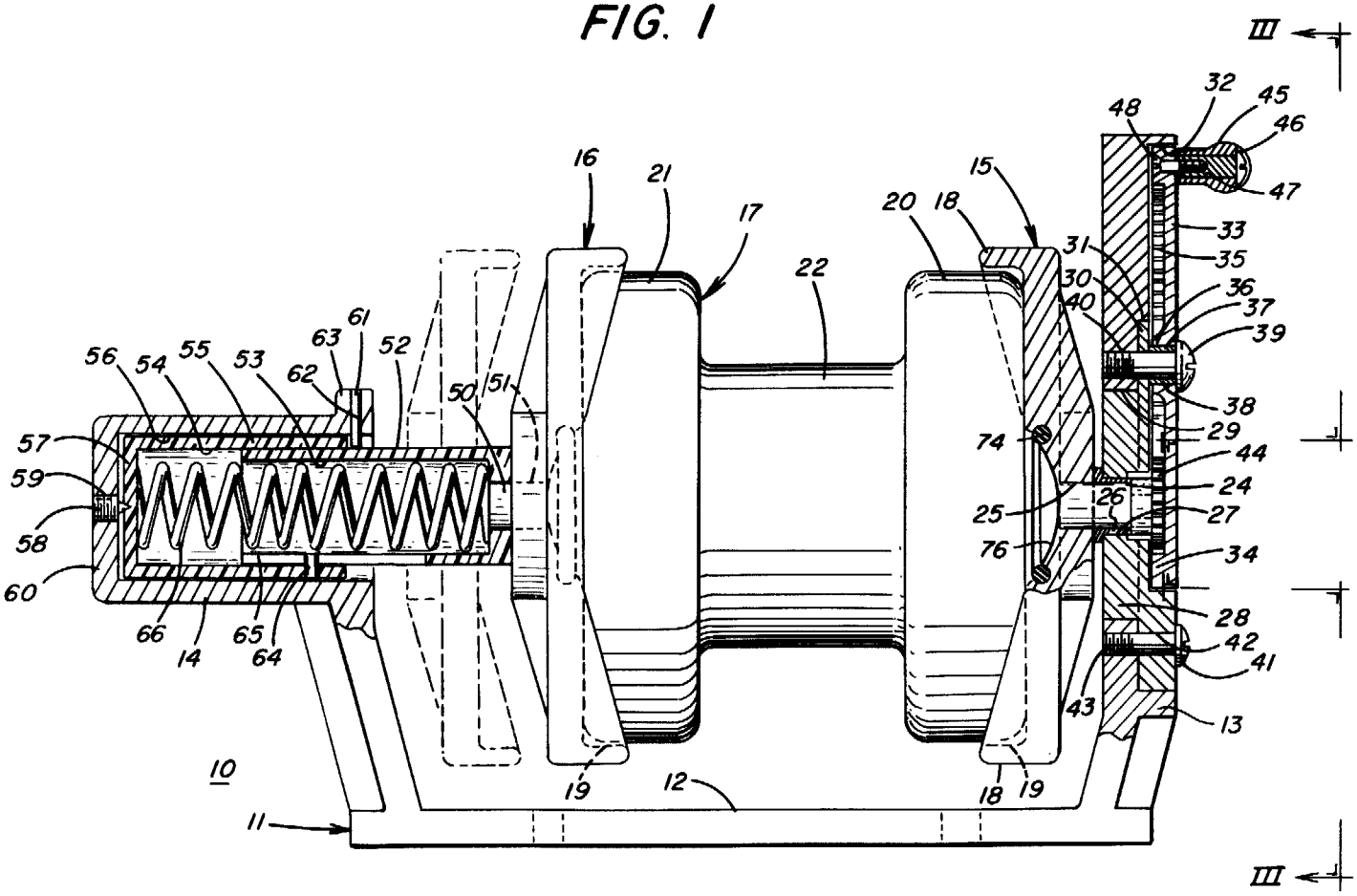
FIG. 1 is a longitudinal elevational view of my invention, partly in section, illustrating one form of marker buoy in position for use of my device to retrieve a line thereon.
Figure 3:
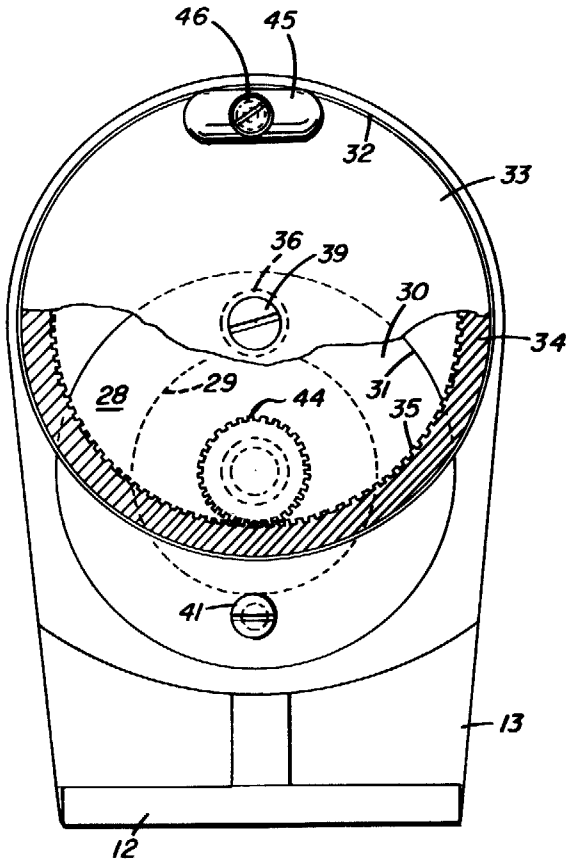
FIG. 3 is an elevational view of the opposite end of my device, taken generally on the line III—III of FIG. 1 and showing certain parts in section.
Figure 2:
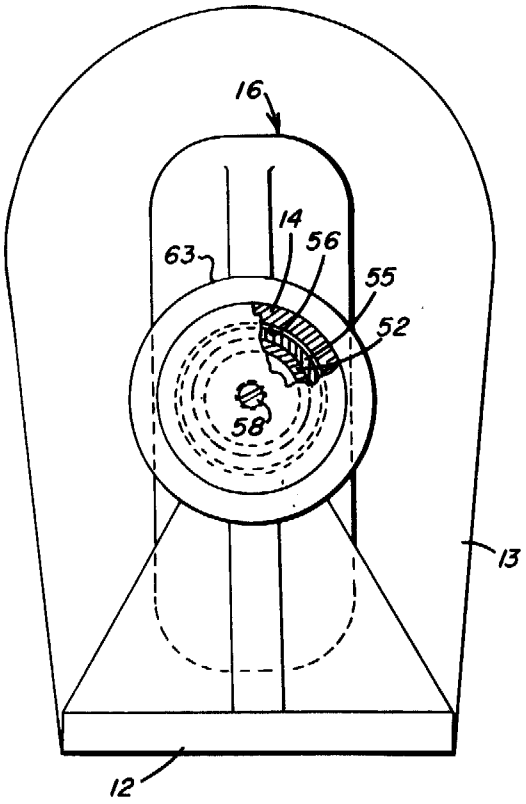
FIG. 2 is an elevational view of one end of my device.

Referring to the drawings, my line retrieving device 10 for marker buoys comprises a rigid housing or frame 11 which has a horizontal base 12. At one end of the base 12 is an integral upstanding pedestal 13 perpendicular to the base and at the opposite end an integral pedestal supporting in a horizontal position a tubular member or bearing member 14. The housing, base and bearing member may be made of suitably rigid and light-weight material, such as aluminum or plastic.

A pair of coaxial rotary holding cups or spindles 15 and 16 are provided for holding a marker buoy 17 therebetween for rotation by hand in the manner hereinafter described. As will be seen in the drawings, the rotary holding cups are substantially rectangular in shape with end flanges 18 facing toward each other to form a pocket 19 in each cup within which to receive and support the respective end portions 20 and 21 of the marker buoy 17. As will be seen, the end portions 20 and 21 of the marker buoy 17 are rectangular in shape so as to fit snugly in the pockets 19 of the rotary cups 15 and 16 and are joined by a neck portion 22 of reduced rectangular cross-sectional area in relation to the size of the end portions 20 and 21. The buoy may be of hollow construction or of suitable light-weight material to insure that it will float.

Rotary cup 15 has a stub shaft 24 secured, as by a press fit, in a bore 25 on the center line of rotation of the cup. The shaft 24 extends through a flanged bushing 26 fitted into a bore 27 of a generally circular member 28, that is in turn fitted into a circular hole 29 in the pedestal 13. Member 28 has a flange or collar 30 thereon of larger diameter than the member 28 and received in a correspondingly larger recess 31 in the pedestal 13.

A circular recess 32 is formed in the outer face of the pedestal 13 in displaced relation to the recess 31. A part of the recess 32 is formed in a thicker area of the circular member 28 which extends to the outer face of pedestal 13 and is flush therewith.

Within the circular recess 32 and of slightly less diameter is a disc 33 which has attached on one side at the periphery thereof an annular gear wheel 34 with internal gear teeth 35. A hub 36 is provided at the center of disc 33, in which is a coaxial bore 37 having a bushing 38 pressed therein. Bushing 38 serves as a bearing for a screw 39 on which the disc 33 rotates. Bushing 38 projects slightly from the inner end of the hub 36 and engages the flange 30 of circular member 28, when screw 29 is tightened in a tapped bore 40 in pedestal 13, to hold the circular member 28 in position in the pedestal, while leaving the disc 33 free to rotate. An additional screw 41 is provided for holding circular member 28 in the pedestal 13. Screw 41 extends through a bore 42 in the circular member 28 and engages in a tapped bore 43 in the pedestal.

Meshing with the teeth 35 of the gear wheel 34 is a pinion 44, the hub of which fits over the inner end of stub shaft 24 and is suitably attached thereon. The end of stub shaft 24 is of slightly reduced diameter to provide a shoulder against which the hub of the pinion 44 seats. The bore 27 in circular member 28 is counterbored to provide slight clearance for the hub of the pinion 44.

The ratio between the number of teeth on the gear wheel 34 and that on pinion 44 may be any one selected, though as shown it is approximately a 4 to 1 ratio.

A handle 45 is provided adjacent the periphery of disc 33 for manually rotating the disc 33 and, through pinion 44, the cup 15. As shown, the handle 45 is loosely carried on a bolt 46 having a tapped bore 47 therein engaged by a flat head screw 48 which extends through a bore in the disc 33. Thus, the operator may grip the handle 45 firmly while rotating the disc 33.

The rotary cup 16, like the cup 15, has a stub shaft 50 pressed in a central bore 51 of the cup. Pressed on the projecting end of the stub shaft 50 is a cylindrical sleeve 52 having an internal broe 53. Sleeve 52 closely fits into a bore 54 within another cylindrical sleeve 55, which in turn has a turning or bearing fit with the bore 56 of the tubular member 14.

Sleeve 55 has a closed inner end wall 57 and a centering screw 58, that is engaged in a tapped bore 59 in the end wall 60 of the tubular member 14, seats in a centering recess in end wall 57.

Sleeve 55 is retained within the bore 56 by a pin 61 that extends through a diametrical bore 62 in the flange 63 of the tubular member 14 with the inner end of the pin projecting into the bore 56. Pin 61 may have a frictional fit with bore 62 or it may have threads to engage corresponding threads in the bore 62.

Sleeve 52 does not rotate within sleeve 55, being prevented therefrom by a diametrical pin 64 in the wall of sleeve 55 which slides in a longitudinal slot 65 in the wall of sleeve 52. As will be apparent in FIG. 1, slot 65 is of such length as to enable cup 16 to be moved away from cup 15 sufficiently to install the end members 20 and 21 of the marker buoy 17 therein. The inner position of the cup 16 is represented by the dotted line view thereof.

A compression coil spring 66 is interposed in caged relation between the end walls of sleeves 55 and 52. Thus, spring 66 yieldingly resists movement of cup 16 away from cup 15 and serves to bias cup 16 toward cup 15 to support the marker buoy 17 in position therebetween. It will now be understood that cup 16 is supported for rotation coaxially with the cup 15 and that with marker buoy 17 in position between the cups 15 and 16, rotation of the marker buoy 17 results in accordance with rotation of the handle 45 on the disc 33.

It will be seen that, with the aid of my line windup device, a fisherman is able to quickly pick up a goodly number of marker buoys in a short period of time and retrieve quickly and easily all the lines on the corresponding marker buoys.

It will be apparent also that my line wind-up device has advantages in that it is readily assembled and disassembled should the need arise. Moreover, it is so constructed as to enable installation and removal of marker buoys readily and quickly.

Figure 4:
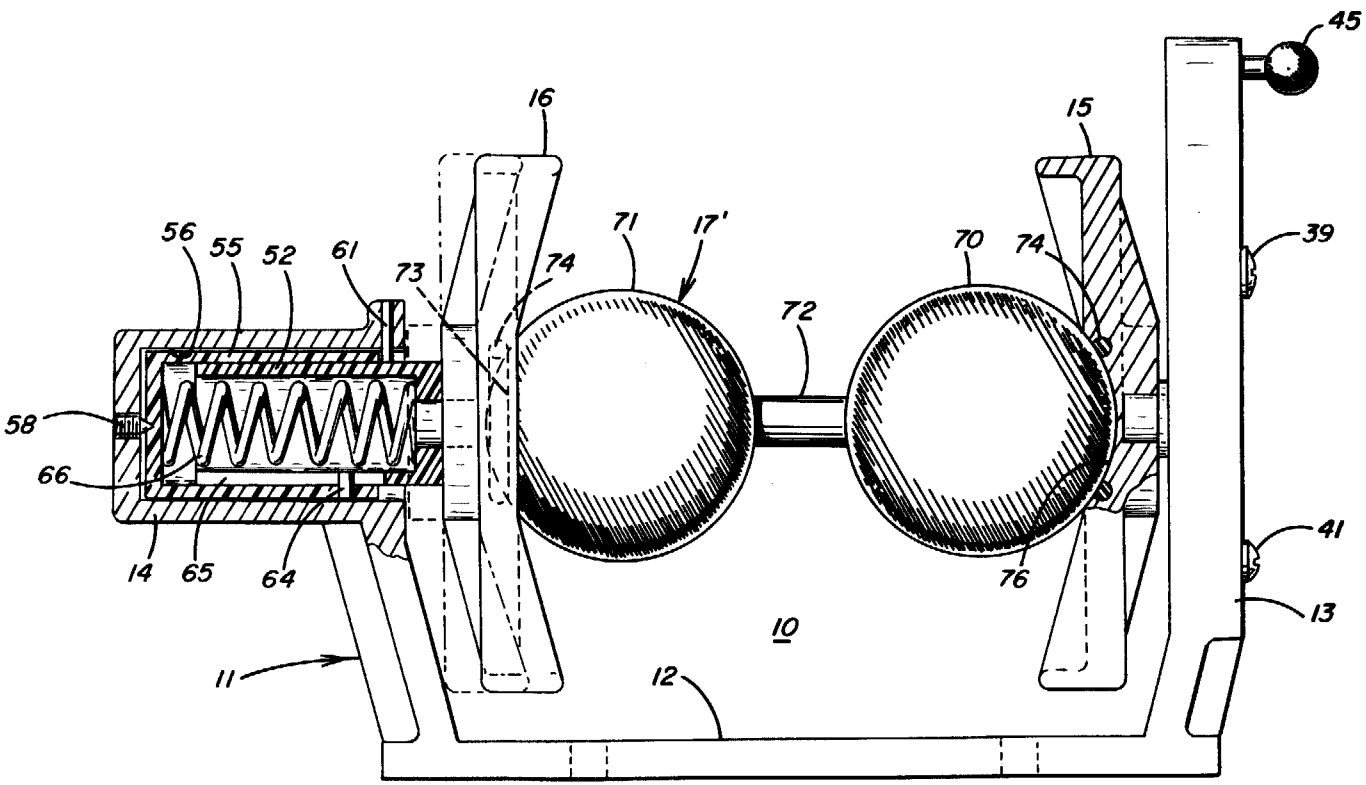
FIG. 4 is a longitudinal elevational view of my invention similar to that of FIG. 1 but illustrating a different form of marker buoy in position for use of my device to retrieve a line thereon.

Referring to FIG. 4, additional features of my line wind-up device 10 will be described. FIG. 4 illustrates a different type of marker buoy 17' installed in the line wind-up device 10. Marker buoy 17' is of the so-called "dumb-bell" type having spherical end members 70 and 71 connected by a cylindrical member 72 on which the line is wound. Buoy 17' is preferably of hollow construction or it may be made of any suitable material to insure that it will float.

In order to retain the spherical end members 70 and 71 in the holding cups 15 and 16, the cups are provided on their opposed faces with central cavities 76 of essentially spherical contour. Moreover, an annular groove 73 of circular cross-section is provided adjacent the outer periphery of each cavity 76 in coaxial relation to the axis of rotation of the cups. Within each of the annular grooves 73 is pressed an O-ring or grommet 74 of rubber or similar composition material. Thus, when the dumb-bell buoy 17' is installed between the holding cups 15 and 16, the biasing force of spring 66 presses the spherical end members 70 and 71 of the marker buoy 17' firmly against the O-rings 74 which retain the connecting member 72 in coaxial alignment with the axis of rotation of cups 15 and 16.

It will be seen that on installation of marker buoy 17', holding cup 16 must move away from cup 15 to allow insertion of the buoy therebetween. In this circumstance, cup 16 is able to move toward the tubular member 14 to the position shown in dotted lines. It will be noted that slot 65 in sleeve 52 is of such length that pin 64 does not contact the end of the slot before the cup 16 reaches its innermost position.

Since the device 10 shown in FIG. 4 is identical to that shown in FIG. 1, the essential parts in FIG. 4 are identified by reference numerals corresponding to those in FIG. 1 without repetitious description.

I claim:

1. A line wind-up mechanism for fisherman's marker buoys comprising a support frame having two coaxially spaced pedestals, a pair of holding cups rotarily mounted on said pedestals respectively for holding a marker buoy therebetween for rotation coaxially with said cups, speed-amplifying gear mechanism comprising an annular driving gear wheel having internal teeth therein and a pinion gear engaging said internal teeth and driven thereby, said pinion gear being connected to one of said cups, and means for manually rotating said annular driving gear wheel.

2. A line wind-up mechanism for fisherman's marker buoys according to claim 1, wherein the driving gear wheel of said speed-amplifying gear mechanism is supported for rotation on one of said pedestals, and said one of said cups has a stub shaft on which said driven gear is fixed.

3. A line wind-up mechanism for fisherman's marker buoys according to claim 2, wherein said one of said pedestals has a recess in its outer face, and wherein said driving gear wheel is rotarily mounted therein, wherein said driving gear wheel has internal gear teeth on the inside face thereof, and wherein said driven gear is supported by said stub shaft in mesh relation with said internal gear teeth on said driving gear wheel.

4. A line wind-up mechanism for fisherman's marker buoys according to claim 1, wherein one of said pedestals has an opening therethrough, and a separable member is fitted in said opening, wherein a circular recess overlies the separable member in said opening, wherein the said driving gear wheel and driven gear both lie within said circular recess and a shaft on said one of said cups to which the driven gear is connected extends through an opening in said separable member to said circular recess and a screw on which the driving gear wheel rotates extends through said separable member to secure said separable member to the said one pedestal.

5. A line wind-up mechanism for fisherman's marker buoys according to claim 1, wherein said holding cups are provided with rectangular pockets in the opposing faces thereof to receive therein marker buoys having end members of a shape conforming to that of said pockets.

6. A line wind-up mechanism for fisherman's marker buoys according to claim 1, wherein the opposing faces of the said holding cups are provided with concave cavities coaxial to the rotational axes of said cups, wherein each of said cups has an annular groove therein normal to the rotational axis thereof and open to the said concave cavity thereof, and wherein an O-ring of elastomeric material is located in said annular groove of each of said cups and projects into said concave cavity to provide a cushioning seat for marker buoys having spherical end members.

7. A line wind-up mechanism for fisherman's marker buoys according to claim 1, wherein means is provided for biasing the other of said holding cups toward said one holding cup to maintain a marker buoy in position therebetween for rotation upon rotation of said one of said cups.

8. A line wind-up mechanism for fisherman's marker buoys according to claim 1, wherein the holding cup other than said one cup has a first cylindrical sleeve fixed coaxially thereon, wherein a second cylindrical sleeve is carried within a bearing bore of a corresponding one of said pedestals, said first cylindrical sleeve being movable telescopically within said second cylindrical sleeve, and interlocked therewith so as to rotate together, and wherein a compression spring is caged between said first and said second cylindrical sleeves to yieldingly bias said other holding cup toward said one holding cup to hold a marker buoy in position therebetween for rotation therewith.

* * * * *